United States Patent [19]

Widmer

[11] Patent Number: 5,018,690

[45] Date of Patent: May 28, 1991

[54] LATCH MECHANISM FOR A RAILBOARD TRACK SWITCH COVER

[76] Inventor: Stanley W. Widmer, R.R. 2, Staples, Minn. 56479

[21] Appl. No.: 513,071

[22] Filed: Apr. 23, 1990

[51] Int. Cl.[5] ..... E01B 7/20; E01F 7/00

[52] U.S. Cl. ..... 246/428; 292/113

[58] Field of Search ..... 246/415 R, 428; 238/8; 104/279; 292/113

[56] References Cited

U.S. PATENT DOCUMENTS

| | | | |
|---|---|---|---|
| 983,982 | 2/1911 | Davis | 238/8 |
| 994,486 | 6/1911 | Svenson | 292/113 |
| 1,153,166 | 9/1915 | Knowles | 238/8 |
| 1,325,977 | 12/1919 | Boardman | 246/428 |
| 1,390,182 | 9/1921 | Ware | 238/8 |
| 1,661,040 | 2/1928 | Gervasio | 246/428 |
| 1,758,519 | 10/1929 | Janville | 246/428 X |
| 1,931,850 | 10/1933 | Moore | 292/113 |
| 2,966,706 | 1/1961 | Christensen | 292/113 X |
| 3,312,820 | 4/1967 | Watkins | 104/279 X |
| 3,806,174 | 4/1974 | Herman | 292/113 |
| 4,671,475 | 6/1987 | Widmer | 246/428 |

*Primary Examiner*—Robert J. Spar

*Assistant Examiner*—Scott L. Lowe

*Attorney, Agent, or Firm*—Burd, Bartz & Gutenkauf

[57] ABSTRACT

A latch mechanism to secure a switch cover panel to a railroad track switch to cover the switch to avoid accumulations of ice and snow that would impede operation of the switch. An anchor bar is positioned beneath the housing of the cover panel. A linkage has a hook at a lower end that engages the anchor bar. The upper end of the linkage is connected to an over-center cam mechanism. A cam member is pivotally connected to a hinge plate secured to the upper surface of the switch cover panel housing. The upper end of the linkage is eccentrically connected to the cam member. A lever rotates the cam member on the hinge plate. Rotation of the cam member moves the upper end of the linkage from a relatively low position to a relatively elevated position to lift the hook for engagement with the anchor bar. Opposite rotation of the cam member releases the hook from the anchor bar. In the release position, the linkage can be rotated to a position out of latching alignment with the anchor bar whereby the switch cover panel can be moved away from the railroad track for purposes of access to the track rail.

19 Claims, 3 Drawing Sheets

18
51
49
51
33
36
40
49
53
47
35
19
37
39
42
38
30
30
46
46
32
44
44
31
44
14B 35
58
40
33
49
47
60
61
61
19
37
60
63
59
32
44
31
14B

LATCH MECHANISM FOR A RAILBOARD TRACK SWITCH COVER

BACKGROUND OF THE INVENTION

Railroad trains move from a single track onto one or two tracks, or from one of the two tracks onto a single track, at a track switch. The track switch involves movement of a pair of switching rails between a pair of stationary rails. The ends of the switching rails are connected by switch rods to maintain a constant distance between them. Switch links acts upon the switch rail ends or the switch rods to move the switch rails and are operated by an actuator such as a switch layer controlled by a motor.

The switching operation of the mechanism is impeded by snow and ice. Large accumulations can render the switch mechanism inoperable as can smaller amounts of very solidly frozen ice. Heating elements are installed at the switches but are inefficient due to rapid heat loss and oftentimes ineffective due to the severity of the climate. To alleviate this problem switch covers can be used which retain heat over the switch and deflect moving snow away from the switch mechanism. See U.S. Pat. No. 4,671,475 issued Jun. 9, 1987 to Widmer. Such a cover assembly is comprised of a plurality of panels placed adjacently between the track rails and along the outside of the track rails in the vicinity of the switch mechanism. The panels must be readily moveable away from the rails of the track for periodic inspection of the track. A conveniently operable latch for holding the panels next to the rails is desirable in order to permit rapid access to the track rail.

SUMMARY OF THE INVENTION

The invention relates to a readily releasable latch mechanism to secure a switch cover panel in place relative to a railroad track switch. An anchor bar is fixed to the track bed as by being fixed between a pair of adjacent crossties and is positioned beneath the housing of a cover panel. An adjustable length linkage has a hook at the lower end that is engageable with the anchor bar. The upper end of the linkage is connected to an over-center cam mechanism. A cam member is pivotally connected to a hinge plate secured to the upper surface of the switch cover panel housing. The upper end of the linkage is eccentrically connected to the cam member. The linkage extends through an opening in the housing.

A lever is connected to the cam member for manual rotation of the cam member on the hinge plate about an arc of approximately 180 degrees. The upper end of the linkage is connected to the cam member at such a location that such rotation of the cam member moves the end of the linkage from a relatively low position on one lateral side of the axis of rotation of the cam member to a relatively elevated position on the other lateral side of the cam member rotational axis along a path passing above the axis of rotation. In low position the hook end of the linkage is positioned beneath the anchor bar in clearing relationship to it. In this position the cam member can be rotated with the hinge plate to move the hook end of the linkage into and out of latching alignment with the anchor bar. When the hook end is out of alignment with the anchor bar, the housing can be lifted away for access to the rail. When it is latching alignment with the anchor bar, rotation of the lever from the lower position to the elevated position raises the hook and brings it into latching engagement with the anchor bar to securely hold the switch cover panel housing in place.

IN THE DRAWINGS

FIG. 3 is an enlarged sectional view of a portion of the switch cover and railroad track of FIG. 1 showing the linkage of the latch mechanism in a relatively lowered position;

DESCRIPTION OF A PREFERRED EMODIMENT

Figure 1:
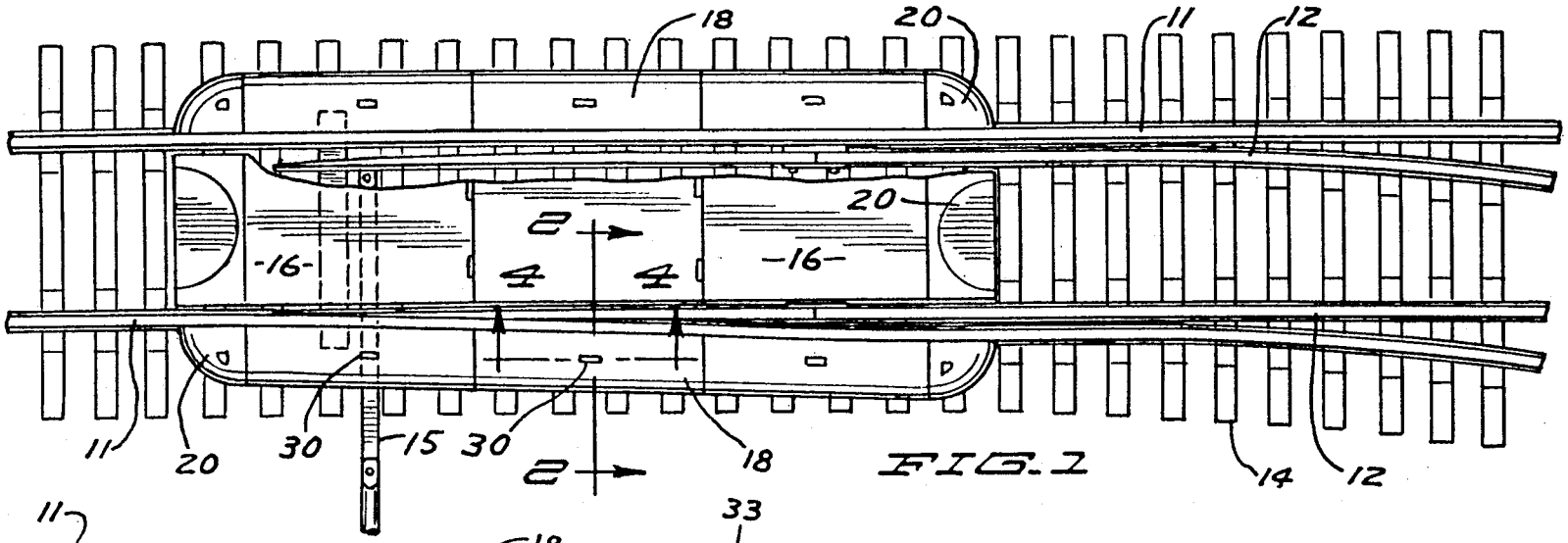
FIG. 1 is a top plan view of a railroad switch cover installed with respect to a railroad track switch and having latch mechanisms according to the present invention.

Referring to the drawings, there is shown in FIG. 1 a top plan view of a railroad track switch and a switch cover comprised as a plurality of panels assembled to the railroad track. A pair of stationary rails 11 mounted on tie-plates 13 on railroad ties 14 are parallel at one point and then are divergent at the entry of the railroad switch. A pair of switch rails 12 have ends located at the divergence of stationary rails 11 and are moveable back and forth between the stationary rails so that one switch rail and one stationary rail cooperate to form one leg of the switch. One or more switch rods 15 are connected to the ends of the switch rails 12 and are functional to move them back and forth through a suitable known mechanism (not shown).

The switch cover includes a plurality of central panels 16 located between the switch rails 12. A plurality of outer panels 18 are located outside of the stationary rails 11. Deflector panels 20 are located at both ends of the central panels 16 and outer panels 18.

Figure 2:
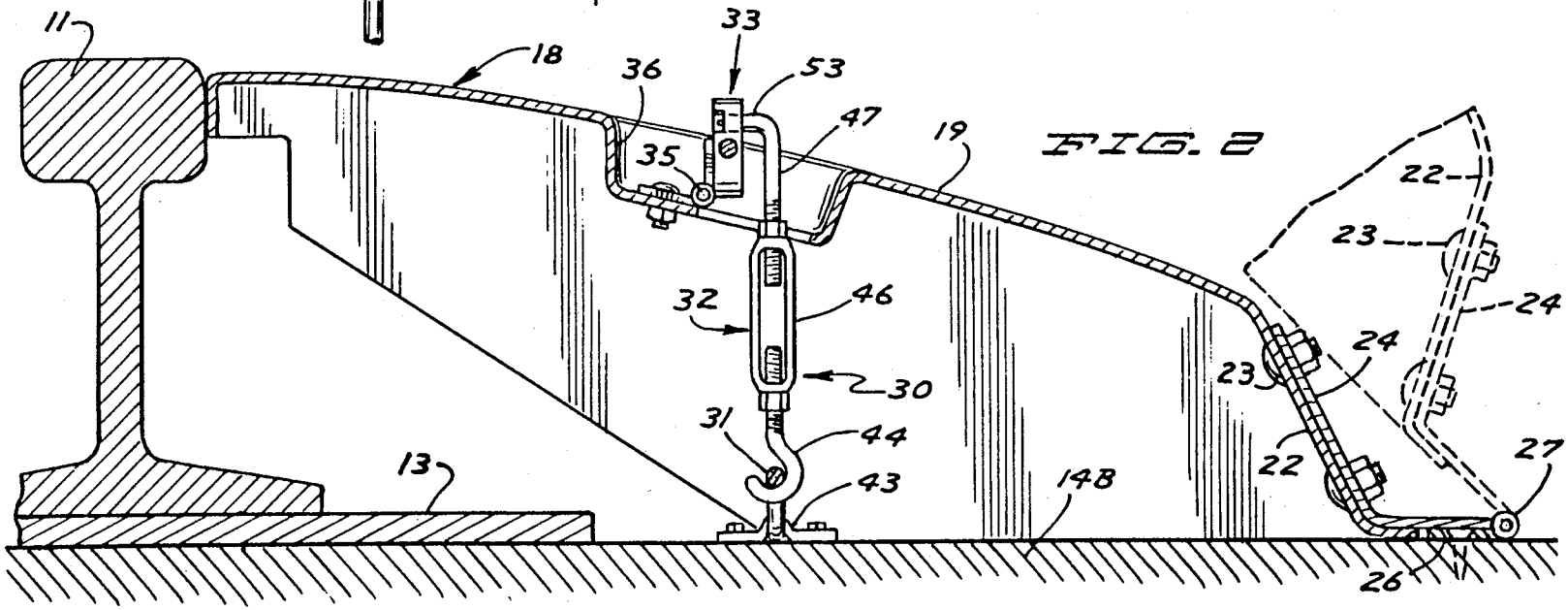
FIG. 2 is an enlarged sectional view of a portion of the switch cover and railroad track of FIG. 1 taken along the line 2—2 thereof.

As shown in FIG. 2, an outer panel 18 includes a housing 19 having one side situated in contact with rail 11 and a top wall sloping away from rail 11 to an opposite side wall 22. One leg 24 of a housing hinge is connected to the side wall 22 by nut and bolt assemblies 23. Leg 24 extends downwardly along side wall 22 and curves outwardly parallel to a railroad tie 14. The second leg 26 of the hinge is located in underlying relationship to the first leg 24 and is fastened to the railroad tie 14. The legs 24, 26 are connected by a hinge pin 27. The housing 19 of the cover panel 18 is pivotal away from the rail 11 as shown in phantom in FIG. 2 in order to provide access to the railroad track for inspection or other purposes.

A latch mechanism 30 according to the invention holds cover panel 18 in place with respect to rail 11. Latch mechanism 30 includes an anchor member or bar 31, a longitudinal rigid linkage 32 engageable and releasable with respect to anchor bar 31, and a cam mechanism 33 connected to linkage 32 and mounted on a cam hinge 35 for pivotal movement about a generally horizontal axis. Hinge 35 is mounted in a depression or well 36 located on the upper surface of housing 19. A fixed hinge plate 37 is secured to housing 19 at the bottom of well 36 by nut and bolt assembly 39. A moveable hinge plate 40 is connected to the fixed hinge plate 37 by a hinge pin 42. The cam mechanism 33 is secured to the movable hinge plate 40.

Anchor bar 31 is mounted with respect to the railroad track bed transversely between adjacent railroad ties 14A and 14B by fastening brackets 43. Anchor bar 31 has clearance beneath it for purposes of engagement and disengagement with a hook 44 comprising the lower or latch end of linkage 32. Linkage 32 has a midportion including a turnbuckle body 46 engaged at one end with a threaded end of hook 44. A linkage pin 47 is located at the upper or cam end of linkage 32 and has a threaded end engaged with the opposite end of turnbuckle body 46. The length of linkage 32 is adjustable by rotation of the turnbuckle body 46 with respect to the ends of the hook 44 and pin 47. Linkage 32 extends through a latch opening 38 in the bottom wall of well 36.

Cam mechanism 33 includes a cam member or disk 49 rotatably connected by a pivot pin 50 to the movable hinge plate 40 of hinge 35 for central rotation about a second axis perpendicular to the first longitudinal axis of linkage 32. A lever 51 is connected to the perimeter of disk 49 for manual rotation of disk 49 on hinge plate 40 about its central axis. Linkage pin 47 is eccentrically pivotally connected to disk 49 at an off-center location or a location radially spaced from the axis of rotation of pivot pin 50. The end of L-leg 53 of linkage pin 47 is movably assembled in a suitable opening provided in the face of disk 49 and is positioned so that back and forth rotation of disk 49 about its central axis is effective to raise and lower the hook 44 into and out of the hooking engagement with anchor bar 31. Linkage 32 is shown in a lowered, unlatched position in FIGS. 3 and 5 with hook 44 spaced beneath locking bar 31 in clearing relationship to it.

In the release position disk 49 is in a rotational position such that the cam end of linkage 32, or the leg 53 of linkage pin 47 is located beneath and to one lateral side of the central axis of disk 49, or between it and the anchor bar 31 as shown in FIG. 3. Lever 51 is positioned to one lateral side of pivot pin 50 on the same side as linkage pin 47. Lever 51 is manually movable to a location on the other lateral side of pivot pin 50 through an arc of approximately 180 degrees to the latched position of FIGS. 1 and 4. Lever 51 is rotated about a path above cam pivot pin 50 moving the cam end of linkage 32 over-center or over pivot pin 50 to the latch position. In the latch position the end of linkage 32 is located substantially diametrically opposite the release position, relatively elevated with respect to it and on the opposite lateral side of pivot pin 50. It is also opposite pivot pin 50 relative to anchor bar 31. Such movement brings hook 44 in an upward direction into latching engagement with anchor bar 31. The outboard end of lever 51 is stopped from further rotation and rests against the top surface of housing 19 at a stop comprised as a shelf 36A of well 36. Some deflection of the wall of housing 19 creates a tension force in linkage tending to bias disk 49 and lever 51 in the latched position and prevent rotational movement toward the release position.

Figure 4:
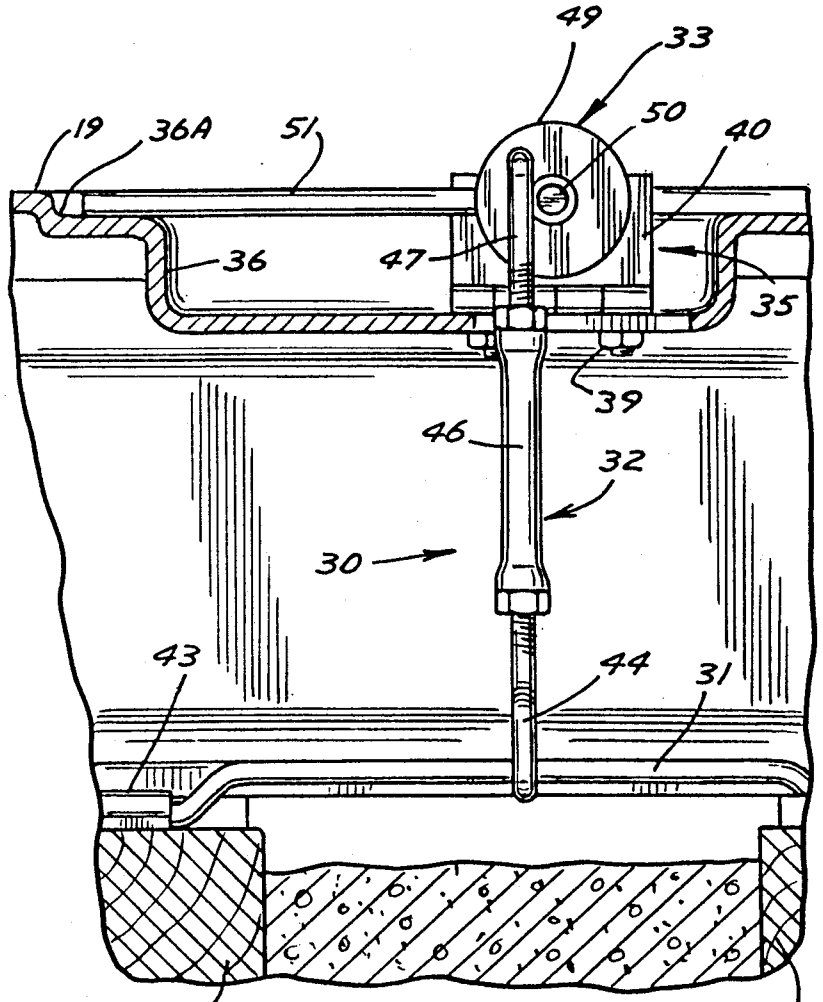
FIG. 4 is an enlarged sectional view of a portion of the switch cover and railroad track of FIG. 1 taken along line 4—4 thereof showing the linkage of the latch mechanism in a relatively elevated position and in latching relationship to an anchor bar.
Figure 8:
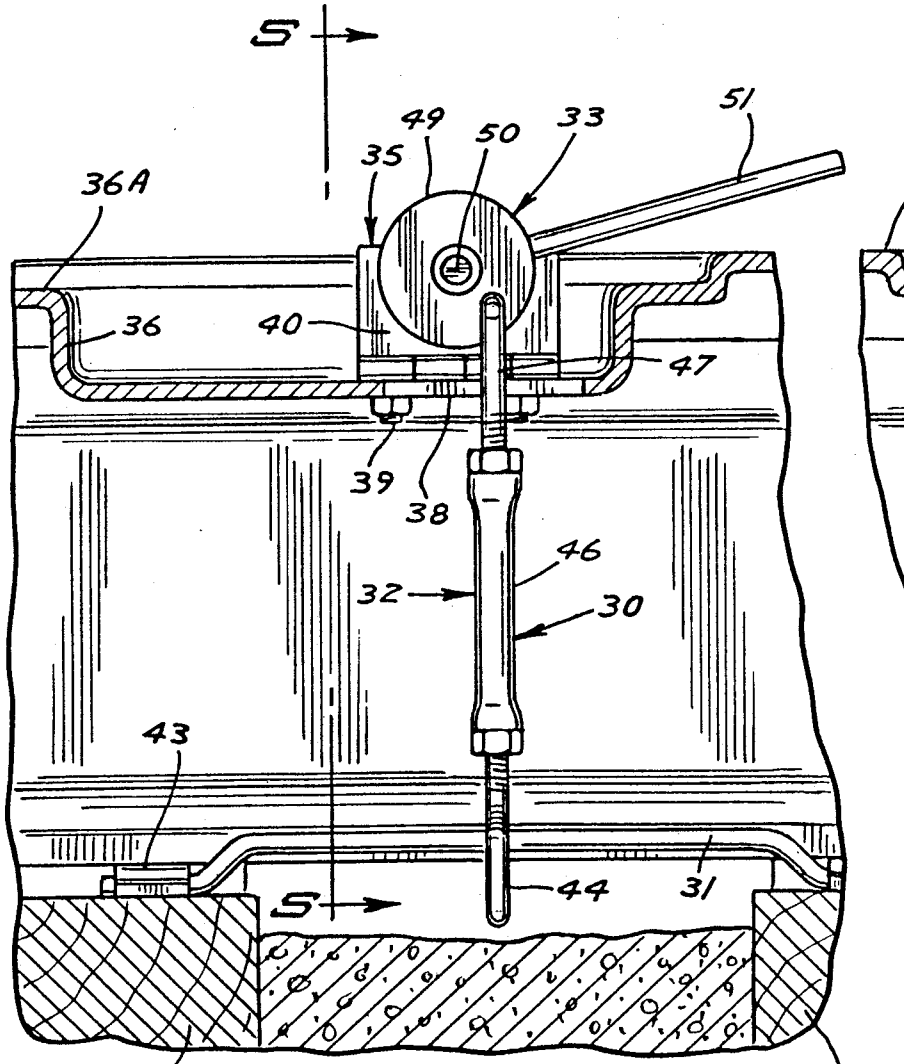
Figure 5:
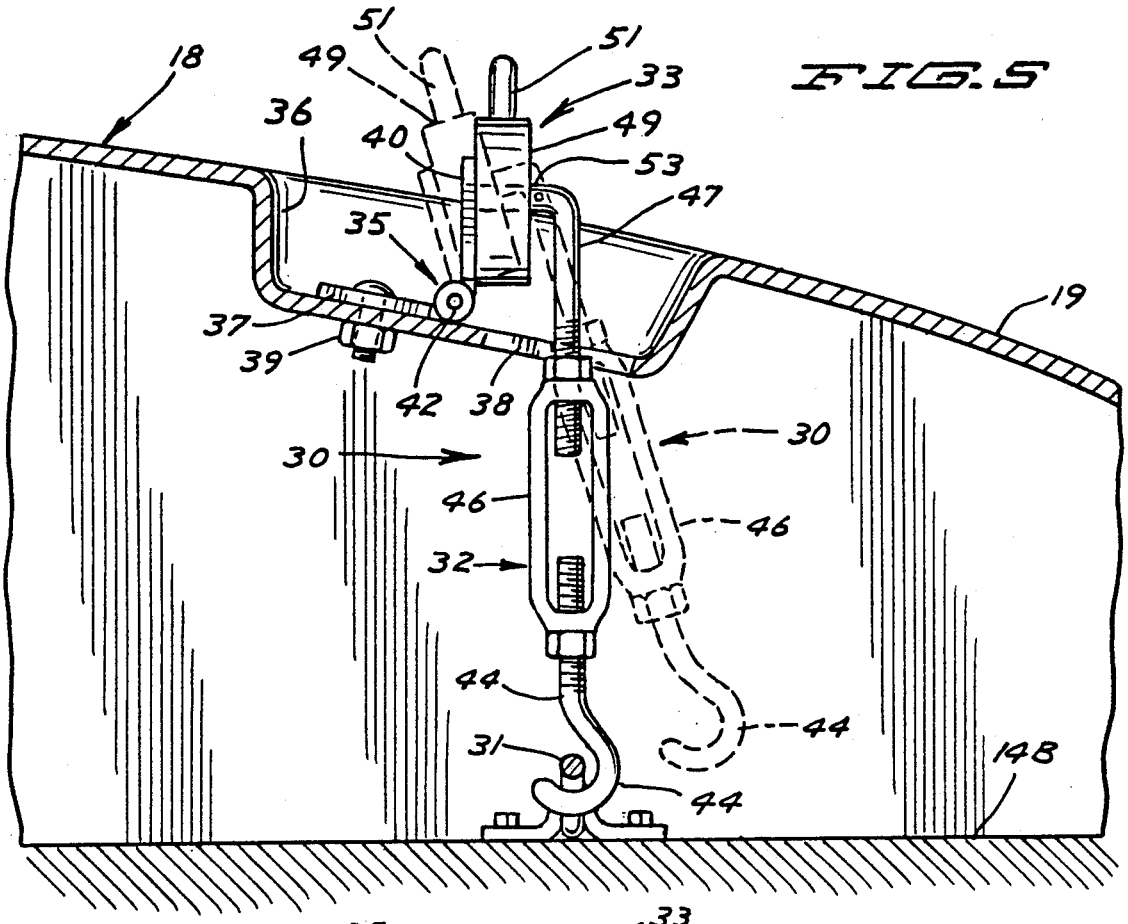
FIG. 5 is an enlarged sectional view of portion of the latch mechanism shown in FIG. 3 taken along the line 5—5 thereof.

Moving the lever 51 in a clockwise direction from the position shown in FIG. 4 to the release position of FIG. 3 moves the disk 49 to the release position and moves the linkage 32 downward. Hook 44 is moved to the position of clearing relationship with respect to the anchor bar 31 as shown in FIG. 5. In this position, the linkage 32 can be rotated along with the cam mechanism 33 on the movable hinge plate 40 to a position shown in phantom in FIG. 5 where the hook is clear of the anchor bar 31 and out of latching alignment with it. From this position the housing 19 can be moved away from anchor bar 31 as by rotating it on housing hinge 24, 26. The reverse procedure is employed to again latch the housing 19 with respect to the anchor bar 31. The proper length of the linkage 32 is achieved by adjustment of the turn buckle body 46 with respect to the treaded ends of the latch hook 44 and the linkage pin 47.

Figure 6:
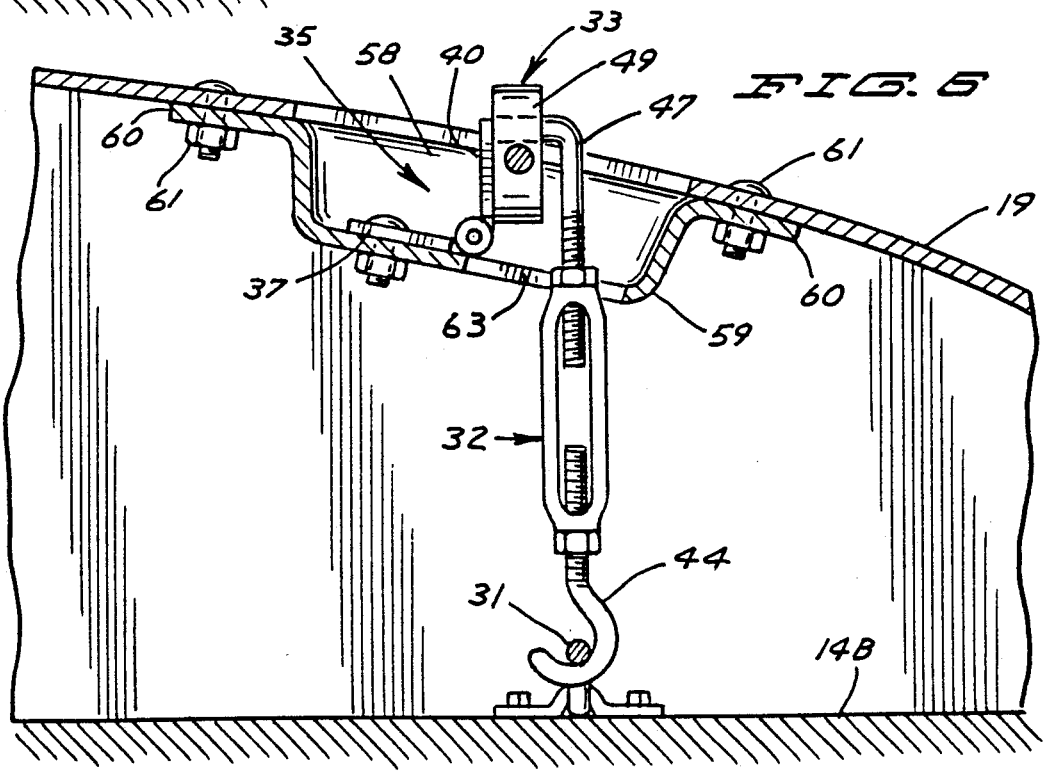
FIG. 6 is an enlarged sectional view like that of FIG. 5 showing a modification of the latch mechanism of the invention.

A modification according to the invention is shown in FIG. 6 and is for installing a cover latch at any desired location on housing 19. An opening 58 is formed on the wall of housing 19 at the desired latch location. A U-shaped bracket 59 is installed on the interior surface of housing 19 in spanning relationship to the opening 58. Bracket 59 has peripheral flanges 60 in contact with the portions of housing 19 adjacent edges of the opening 58. Nut and bolt assemblies 61 secure the flanges 60 to the housing 19. Bracket 59 has an opening 63 for extension of the linkage 32 of the latch assembly. The linkage pin 47 engages the cam member 49 of the cam assembly 33 mounted on the moveable hinge plate 40 of hinge 35. The fixed hinge plate 37 of hinge 35 is secured to the bottom wall of bracket 59 adjacent the linkage opening 63. Locking bar 31 is disposed in alignment with the linkage 32 beneath the linkage opening 63 of bracket 59. Use of the bracket 59 permits retrofitting switch covers with latch assembly 30 or permits installation of latch assembly 30 at locations not having a well of the type shown at 36 in FIG. 3.

While there has been shown and described certain preferred embodiments according to the invention it will be apparent that certain deviations can be had without departing from the scope and spirit of the claims.

The embodiments of the invention which exclusive property of privilege is claimed are defined as follows:

1. A latch mechanism to hold down a railroad track switch cover housing positionable over a section of railroad track bed, comprising:

an anchor member securable to the track bed;

an elongate linkage rotatable about a first axis and having a cam end and a latch end;

said latch end of the linkage having hook means engageable with the anchor member when secured to the track bed;

a cam mechanism mounted on the housing having a cam member rotatably mounted for rotation about a second axis perpendicular to the first axis of the linkage;

said cam end of the linkage being eccentrically connected to the cam member for longitudinal movement of the linkage between a latch position with the hook means in engagement with the anchor member and a release position with the hook means clear of the anchor member; and means for back and forth rotation of the cam member between the latch position of the linkage and the release position of the linkage.

2. The latch mechanism of claim 1 including: means for the adjustment of the length of the linkage.

3. The latch mechanism of claim 2 wherein: said linkage includes a turnbuckle.

4. The latch mechanism of claim 2 wherein: said linkage includes a turnbuckle body, said hook means including a hook engageable with the anchor member andd having a threaded end in engagement with one end of the turnbuckle body; said cam end of the linkage comprises as an L-shaped linkage pin, one end of the linkage pin moveable connected to the cam member, the other end of the linkage pin being threaded and in engagement with the opposite end of the turnbuckle body.

5. The latch mechanism of claim 4 wherein: said anchor member is comprised as an anchor bar.

6. The latch mechanism of claim 5 including: a cam hinge connecting the cam member to the housing, said cam hinge having a first plate fixed to the housing and a second plate hingeably connected to the first plate, said cam member being rotatably connected to the second plate for rotation about said second axis, said second plate orientating the cam member so that pivotal movement of the second plate relative to the first plate when the cam member is in the release position is effective to rotate the linkage assembly out of latching alignment with the anchor bar.

7. The latch mechanism of claim 6 wherein: the end of the linkage pin is connected to the cam member at a location to be positioned between the second axis of rotation of the cam member and the anchor bar on one lateral side of the central axis of the cam member when in the release position, and on the opposite lateral side of the second axis of the cam member and opposite the second axis of the cam member relative to the anchor bar when in the latch position.

8. The latch mechanism of claim 7 including: a lever connected to the cam member for movement of the cam member between the latch position and the release position.

9. A latch mechanism to hold down a railroad switch cover housing having a latch opening and positionable over a section of railroad track bed, comprising:

an anchor member securable to a railroad track bed beneath the latch opening of the housing;

an elongate linkage rotatable about a first axis and having a cam end and a latch end, said latch end having a hook that is engageable and releasable with respect to the anchor member when the anchor member is secured to the track bed, said cam end having a linkage pin;

a cam mechanism including a cam member and a cam hinge, said cam hinge having a fixed plate secured to the housing adjacent the latch opening, and a second plate pivotally connected to the first plate;

said cam member rotatably connected to the second hinge plate for rotation about a second axis;

said linkage pin eccentrically connected to the cam member, with the first axis of the linkage perpendicular to the second axis of the cam member, at a location on the cam member movable upon rotation of the cam member between a release position with the end of the linkage pin in a relatively lowered location and on one lateral side of the axis of rotation of the cam member and with the hook in clearing relationship to the anchor member, and a latch position with the end of the linkage pin in a relatively elevated location on the opposite lateral side of the second axis of the cam member and the hook in engagement with the anchor member;

means fixed to the cam member for rotation of the cam member between the latch position and the release position.

10. The latch mechanism of claim 9 wherein: said means fixed to the cam member for rotation of the cam member includes a lever positioned on the cam member for movement from one lateral side of the axis of rotation of the cam member to the opposite lateral side along a path above the axis of rotation, moving the end of the linkage pin between the latch position and the release position along a path above te axis of rotation of the cam member from one lateral side of the axis of rotation of the cam member to the opposite lateral side.

11. The latch mechanism of claim 10 wherein: said linkage includes a turnbuckle body, said hook having a threaded end in engagement with one end of the turnbuckle body, said linkage pin having a threaded end in engagement with the opposite end of the turn buckle body.

12. The latch mechanism of claim 11 including: a U-shaped bracket securable to the lower surface of the housing, said first plate of the cam hinge being fixed to the U-shaped bracket, said U-shaped bracket having said latch opening, said linkage extending through the latch opening.

13. The latch mechanism of claim 10 wherein: said cam member is a disk, said lever being assembled to the perimeter of the disk.

14. The latch mechanism of claim 13 wherein: said lever is assembled to the perimeter of the disk so as to be on the same lateral side of the axis of rotation as the end of the linkage pin and being moveable between the latch position and the released position along a path above the second axis of rotation of the cam member to move the end of the linkage pin between the release position and the latch position along a path above the second axis of rotation of the cam member between lateral sides thereof.

15. A railroad track switch cover panel assembly positionable over a section of railroad track bed adjacent a railroad track rail, comprising;

a housing having a first wall positionable adjacent a railroad track rail, a top wall extending from the first wall in covering relationship to the railroad track bed section adjacent the rail, and a second wall spaced from the first wall and resting on the railroad track bed when the first wall is located adjacent a railroad track rail;

a latch opening in the top wall of the housing;

an anchor bar securable to the track bed at a location beneath the latch opening;

an elongate linkage rotatable about a first axis and having an upper end and a lower end;

said lower end of the linkage having a hook engageable with the anchor bar when the anchor is secured to the track bed beneath the latch opening;

lever means rotatably mounted on the upper surface of the top wall of the housing for rotation about a second axis perpendicular to the first axis of the linkage;

said upper end of the linkage being eccentrically connected to the lever means for longitudinal movement of the linkage between a latch position with the hook in engagement with the anchor bar and a release position with the hook clear of the anchor bar upon rotation of the lever means about the second axis; and means for back and forth rotation of the lever means about its central axis between the latch position of the linkage and the release position of the linkage.

16. The switch cover panel assembly of claim 15 wherein: said linkage includes a turnbuckle for adjustment of the length thereof.

17. The switch cover panel assembly of claim 16 wherein: said lever means includes a cam hinge having a fixed plate fixed to the housing and a movable plate pivotally connected to the fixed plate in position for movement over and away from the latch opening, a cam member rotatably connected to the second plate of the cam hinge for rotation about said second axis, and a lever secured to the perimeter of the cam member for rotation of the cam member between the latch position of the linkage and the release position of the linkage.

18. The switch cover panel assembly of claim 17 including: a well located on the top wall of the housing, said latch opening located in a bottom wall of the well, said cam hinge being fastened to the housing in the well.

19. The switch cover panel assembly of claim 18 including: housing hinge means connecting the second wall of the housing to the railroad track bed.

* * * * *

UNITED STATES PATENT AND TRADEMARK OFFICE

CERTIFICATE OF CORRECTION

PATENT NO. : 5,018,690

DATED : May 28, 1991

INVENTOR(S) : Stanley W. Widmer

It is certified that error appears in the above-identified patent and that said Letters Patent is hereby corrected as shown below:

Col. 1, line 6, "or" should be --- of ---.

Col. 1, line 12, "acts" should be --- act ---.

Col. 1, line 59, insert "the" after --- In ---.

Col. 2, line 22, insert "a" after --- view of ---.

Col. 3, line 39, delete "the" after --- out of ---.

Col. 4, line 36, insert "the" before --- bracket ---.

Col. 5, line 10, "andd" should be --- and ---.

Col. 6, line 15, "te" should be --- the ---.

Col. 6, line 59, insert "bar" after --- anchor ---.

(second occurance)

Signed and Sealed this

Sixth Day of October, 1992

*Attest:*

*Attesting Officer*

DOUGLAS B. COMER

*Acting Commissioner of Patents and Trademarks*